US007510471B2

(12) United States Patent
Lee et al.

(10) Patent No.: US 7,510,471 B2
(45) Date of Patent: Mar. 31, 2009

(54) FLOW SPREADING MECHANISM

(75) Inventors: Sung Hwa Lee, Gwangsan-gu (KR); Yoon Seob Eom, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 46 days.

(21) Appl. No.: 10/537,155

(22) PCT Filed: Dec. 3, 2002

(86) PCT No.: PCT/KR02/02272

§ 371 (c)(1),
(2), (4) Date: May 31, 2005

(87) PCT Pub. No.: WO2004/051165

PCT Pub. Date: Jun. 17, 2004

(65) Prior Publication Data

US 2006/0057955 A1 Mar. 16, 2006

(51) Int. Cl.

| | |
|---|---|
| ***F24F 7/00*** | (2006.01) |
| ***F24F 13/04*** | (2006.01) |
| ***F24F 13/06*** | (2006.01) |
| ***B05B 1/08*** | (2006.01) |

(52) U.S. Cl. ..... 454/237; 454/261; 454/284; 239/589.1; 366/336

(58) Field of Classification Search ..... 454/284, 454/299, 305, 237, 261; 62/186; 239/11, 239/589.1; 366/336

See application file for complete search history.

(56) References Cited

U.S. PATENT DOCUMENTS 3,023,589 A * 3/1962 Jacobs ..... 62/156
4,002,293 A * 1/1977 Simmons ..... 239/11
4,151,955 A * 5/1979 Stouffer ..... 239/11

(Continued)

FOREIGN PATENT DOCUMENTS

FR 2043074 A 2/1971

(Continued)

OTHER PUBLICATIONS

Attached machine-generated English translation for JP 07-151108 A.*

(Continued)

*Primary Examiner*—Steven B McAllister
*Assistant Examiner*—Patrick F. O'Reilly, III
(74) *Attorney, Agent, or Firm*—Birch, Stewart, Kolasch & Birch, LLP

(57) ABSTRACT

The present invention relates to a flow spreading mechanism, in particular a flow spreading mechanism used with refrigerators or air conditioners to enhance spreading of cool or warm air. To achieve the above-mentioned object, this invention comprises at least one inlet (200) through which fluid flow comes in; a flow separator means (110) dividing the flow coming through the at least one inlet (200) into at least two separate flows; and an outlet (300) through which at least two of the at least, two flows having been divided into separate flows by the flow separator means go out after they meet again, thereby forming complex vortices near the outlet, which make the flow going out of the outlet swing. Flow spreading mechanism of the present invention provides a better uniformity of temperature distribution for refrigerators or air conditioners, compared with the simple-ducted outlet of the prior art.

15 Claims, 9 Drawing Sheets

U.S. PATENT DOCUMENTS 4,304,098 A * 12/1981 Rydahl ..... 62/82
4,326,452 A * 4/1982 Nawa et al. ..... 454/258
4,327,869 A * 5/1982 Nawa et al. ..... 239/590.5
4,498,786 A * 2/1985 Ruscheweyh ..... 366/336
4,514,344 A * 4/1985 Ruscheweyh ..... 261/159
4,527,903 A * 7/1985 Ruscheweyh ..... 366/337
4,556,172 A * 12/1985 Sugawara et al. ..... 239/590.5
4,562,867 A * 1/1986 Stouffer ..... 137/811
4,672,886 A * 6/1987 Stouffer ..... 454/127
4,807,523 A * 2/1989 Radtke et al. ..... 454/137
4,971,768 A * 11/1990 Ealba et al. ..... 422/176
5,003,810 A * 4/1991 Jepson et al. ..... 73/196
5,035,361 A * 7/1991 Stouffer ..... 239/589.1
5,052,285 A * 10/1991 Rich ..... 454/301
5,099,753 A * 3/1992 Stouffer ..... 454/125
5,853,624 A * 12/1998 Raghu et al. ..... 261/81
6,135,629 A 10/2000 Dohmann
6,186,886 B1 * 2/2001 Farrington et al. ..... 454/141
2001/0053108 A1 12/2001 Jahn

FOREIGN PATENT DOCUMENTS

FR 2784313 A 4/2000
GB 2106240 A * 4/1983
JP 07-151108 A 6/1995

OTHER PUBLICATIONS

Chinese Office Action with English Translation.

* cited by examiner

FLOW SPREADING MECHANISM

TECHNICAL FIELD

The present invention relates to a flow spreading mechanism, and more particularly, to a flow spreading mechanism used in a freezer or an air conditioner, etc., for enhancing the diffusion of cold or warm air. However, the flow spreading mechanism is not limited to the use in the freezer or the air conditioner, and can be used to enhance the diffusion of a discharged flow in any kinds of apparatus or systems, etc. having a flow outlet.

BACKGROUND ART

Generally, a conventional flow outlet used in a refrigerator or an air conditioner is mostly a simple-ducted outlet that is simply opened at its one end.

Sometimes, rotatable louvers are installed in the refrigerator or the air conditioner so as to change the discharging direction of the outlet at any time.

However, the conventional flow outlet has problems as follows.

First, in case of the simple-ducted outlet, flow is discharged in a predetermined direction only so that the heat transfer due to the flow just locally happens, and the flow is hardly diffused beyond the flow path into which the flow is normally discharged. As a result, only local cooling or heating occurs. Therefore, optimum cooling or heating cannot be effected because the uniform temperature distribution across the overall space cannot be expected.

Next, in the case of using rotatable louvers, a circularly reciprocating motion can be expected in such a manner that the louver moves automatically within a predetermined angle by an electrical motor, etc. In this case, the rotatable louvers change the discharging direction of the flow continuously so that the flow is diffused relatively uniformly and the heat transfer due to the flow can be achieved all over. However, the installation of the rotatable louvers requires additional high expenses, and the expenses for its maintenance are increased. In the meantime, even when installing the rotatable louvers, the flow diffusion and the heat transfer due to the flow diffusion hardly occur beyond the range of the louver operation. Therefore, the conventional flow spreading mechanism has a limitation to fully provide uniform heat transfer.

DISCLOSURE OF THE INVENTION

Accordingly, the present invention is directed to a flow spreading mechanism that substantially obviates one or more of the problems due to limitations and disadvantages of the related art.

An object of the present invention is to provide a flow spreading mechanism for diffusing the fluid discharged from an outlet to a much wider space in the up-and-down and/or right-and-left direction of the flow.

Another object of the present invention is to provide a flow spreading mechanism enabling the fluid discharged from an outlet to be diffused and the heat due to the flow of the fluid to be transferred even to the place where the fluid could not directly reach due to the limitation caused by the size or the shape of the outlet or the deflection of the louver provided for the outlet.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described herein, the flow spreading mechanism may include at least one inlet through which a fluid flow is introduced; a flow separating means for separating the fluid flow introduced through the at least one inlet into at least two fluid flows; and an outlet for discharging at least two of the at least two fluid flows, which are divided by the flow separating means and joined together thereafter.

In addition, complex vortices are formed adjacent to the outlet and thus, the fluid flow being discharged through the outlet swings while proceeding.

To further achieve these and other advantages and in accordance with the purpose of the present invention, the flow spreading mechanism may be configured such that the outlet is installed in a space, and at least one sink is installed at a predetermined location inside the space, the sink comprising an opening for discharging the fluid inside the space to the outside.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings.

Figure 1A:
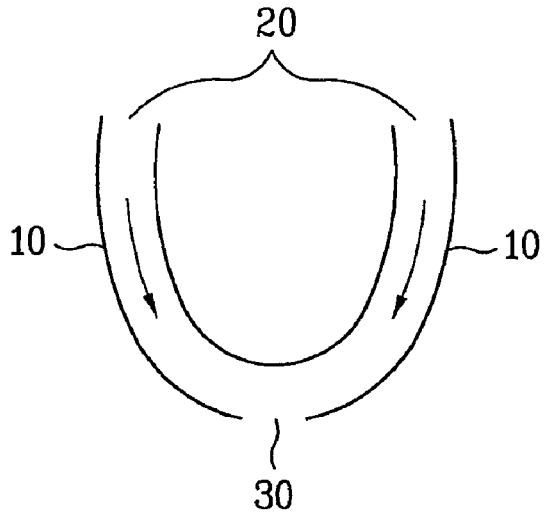
FIGS. 1A to 1C are schematic views of a flow spreading mechanism according to a first embodiment and its modification of the present invention.

FIG. 1A is a schematic view of a flow spreading mechanism according to a first embodiment of the present invention.

Referring to FIG. 1A, the flow spreading mechanism according to a first embodiment of the present invention includes two conduits 10 each having an inlet 20, which are constructed to meet at a point, and a flow outlet 30 formed at the point where the two conduits meet. The two conduits are, as a whole, substantially U-shaped.

With reference to FIG. 1A, the operation of the flow spreading mechanism according to the first embodiment of the present invention is illustrated. The flows introduced through the inlets 20 and flowing along each conduit 10 collide with each other right prior to being discharged through the outlet 30 to thereby form an unsteady-state chaos flow.

The chaos flow includes a plurality of large and small vortices, and thus the flow discharged through the outlet 30 swings right-and-left, so that the flow is spread right-and-left.

The flow spreading effect in the present embodiment can be optimized when the flow rates of the respective flows flowing through the two conduits 10 are the same, which means that the flow speeds of the respective flows flowing through the two conduits 10 are the same when the two conduits 10 are made with the same shape and dimension or have at least the same cross-sectional area of the flow path. When the flow rates of the flows through the two conduits 10 are not the same and have a large difference, the state of the flow discharged through the outlet 30 depends on the state of the flow with the higher flow rate. Therefore, the interaction between the two flows is weak, and thus the discharged flow is weakly or hardly vibrated.

Figure 1B:
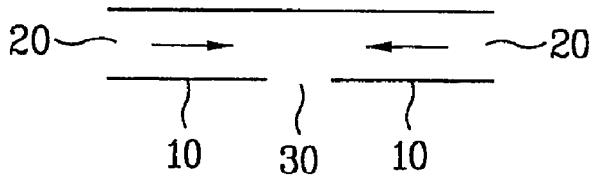
Figure 1C:
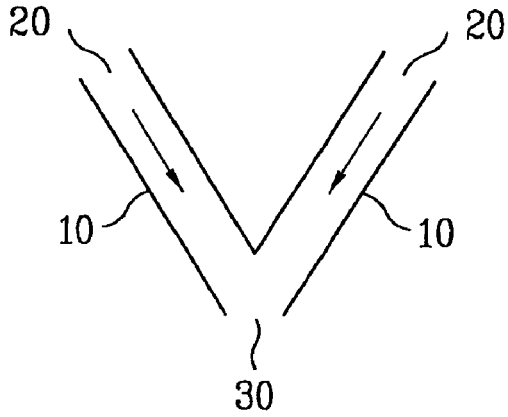

FIGS. 1B and 1C are views of the modifications of the first embodiment of the FIG. 1A, and the two conduits 10 are a straight line-shape and a V-shape respectively as a whole.

In the meantime, though, in the embodiments of FIGS. 1A to 1C, two conduits are configured to have their own inlets, two conduits with one common inlet will operate substantially the same way and substantially the same result will be obtained.

Figure 2A:
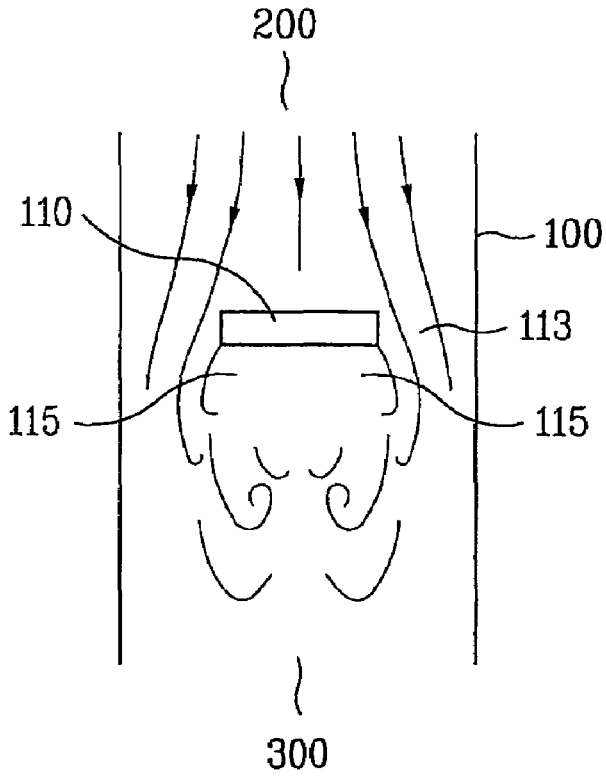
FIGS. 2A to 2K are schematic views of a flow spreading mechanism according to a second embodiment and its modification of the present invention.
Figure 2B:
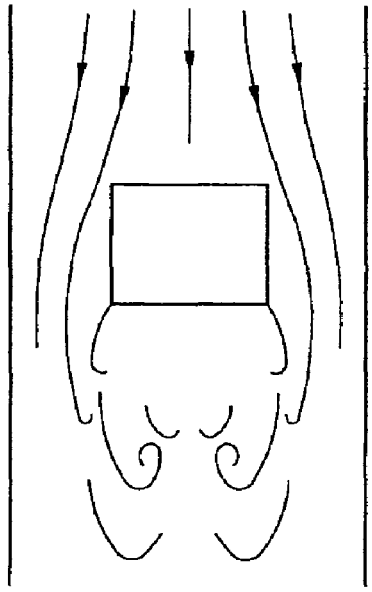
Figure 2C:
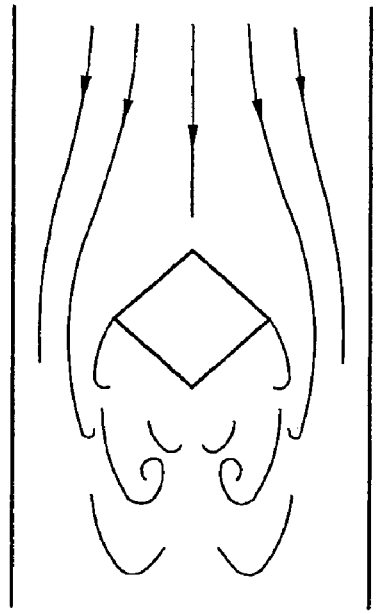
Figure 2D:
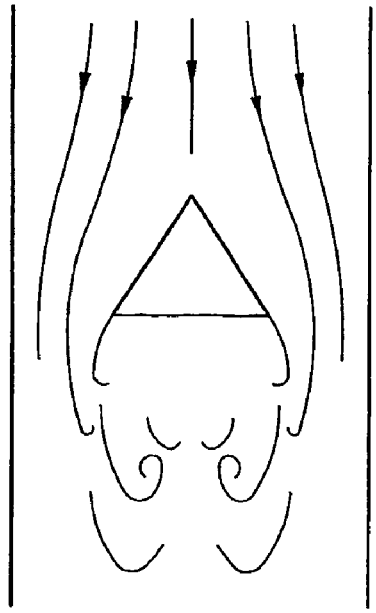
Figure 2E:
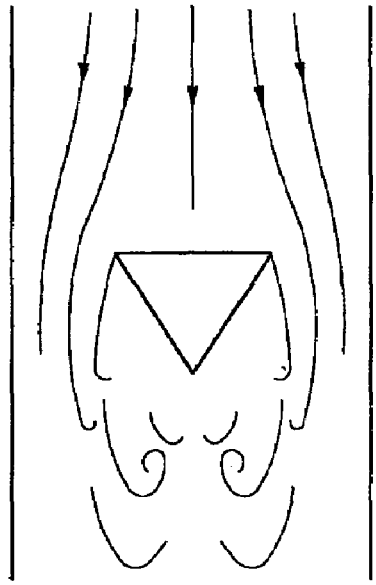
Figure 2F:
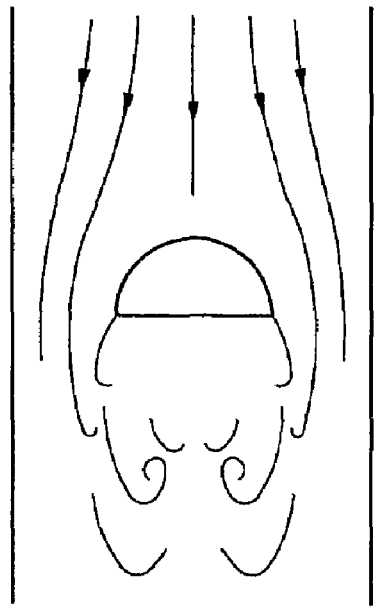
Figure 2G:
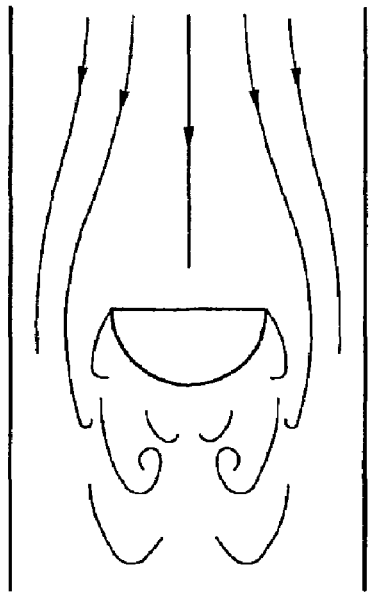
Figure 2H:
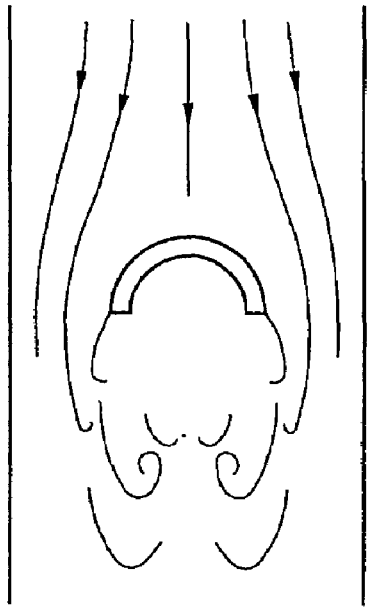
Figure 2I:
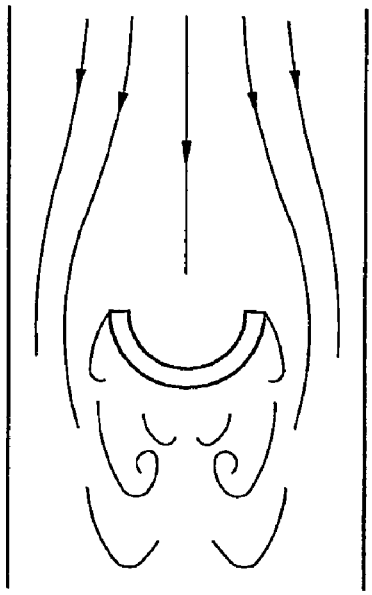
Figure 2J:
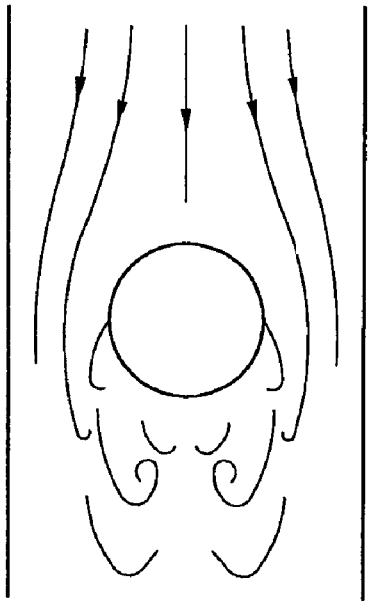
Figure 2K:
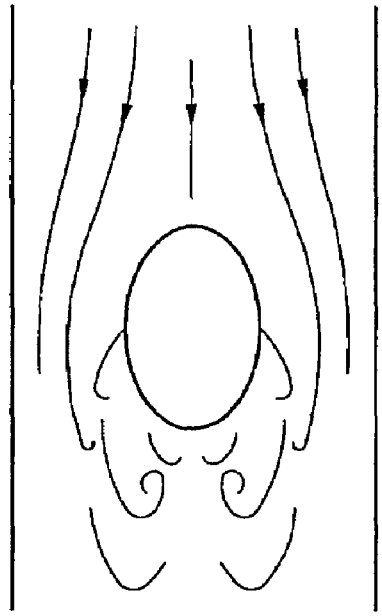

FIG. 2A is a schematic view of a flow spreading mechanism according to a second embodiment of the present invention.

Referring to FIG. 2A, the flow spreading mechanism of the present embodiment includes a conduit 100 having an inlet 200 and an outlet 300, and a blunt body 110 placed inside the conduit 100 and forming two separated flow paths therein. In the embodiment of the drawing, the blunt body 110 is formed of a plate which is installed perpendicular to the streamline, and forms two separated flow paths, though extending over only a short distance, on the right and left of the blunt body 110.

With reference to FIG. 2A, the operation of the flow spreading mechanism according to the second embodiment of the present invention is illustrated as follows. In the present embodiment, upon considering that one flow is temporarily divided into two by means of the blunt body 110, and the separated flow paths are joined again into one flow path, it is difficult to expect the creation of vortices by the collision of the flows flowing the two separated flow paths, unlike the first embodiment. However, adverse pressure gradient is formed in a flow boundary layer formed on the surface of the blunt body 110 by the existence of the blunt body 110, and thereby the flow flowing through the conduit 100 separates at a point on the blunt body 110. As a result, vortices are formed after the separation point, and it becomes possible to form a flow which swings while proceeding by the vortices formed at the both back sides 115 of the blunt body 110; the two vortices are variable in their size and intensity while having constant frequency which is determined by an introduction rate of the flow, and a shape and size of the blunt body 110; the discharged flow thus swings right and left while proceeding.

The blunt body can be constructed to form a separated flow path only in a part of the conduit or to be placed along a greater length of the conduit. However, for the purpose of the present invention, it is sufficient to form separated flow paths in a part of the conduit, which is more preferable. Meanwhile, to obtain a maximum fluid spreading effect by the flow generated by the interference between the two vortices and swinging while proceeding, it is preferable to locate the outlet right after the point where the interference between the two vortices occurs. In other words, it is preferable to locate the outlet of the conduit adjacent to a point where the two separated flow paths formed by the blunt body 110 meet.

In case that a blunt body is provided inside the conduit as above, the resistance against the flow is increased several times greater than that in a simple-ducted outlet, so that energy loss is increased. Therefore, it is necessary to select a blunt body having a shape to provide a smaller drag coefficient.

FIGS. 2B to 2K are views of the various modifications of the second embodiment of FIG. 2, and illustrate the flow spreading mechanism of the present invention employing a blunt body having various cross-sectional shapes.

The blunt bodies in FIGS. 2B to 2I, which have sharp edges, have mostly constant drag coefficients at Reynolds Nos. above about $10^4$ because they create separation regardless of the characteristics of flow boundary layers, i.e., laminar/turbulent boundary layers generated on the surface of the blunt body, just like the plate of FIG. 2A. The drag coefficient of the plate perpendicular to the direction of the flow illustrated in FIG. 2A is 2.0, as is widely known, and the rectangular-shaped blunt body in the cross-section in FIG. 2B, which is installed to make its one side perpendicular to the direction of the flow, also has 2.0 of drag coefficient. However, the closer to streamline-shape a blunt body is, the lower drag coefficient it has. The blunt bodies illustrated in FIGS. 2C, 2D, 2F, 2H have 1.50, 1.40, 1.20, 1.20 of drag coefficients respectively. In case of a round-shaped and an oval-shaped blunt body in the cross-section illustrated in FIGS. 2J and 2K, drag coefficient can be varied depending on whether the flow boundary layer is a laminar boundary layer or a turbulent boundary layer. Even in case that a laminar boundary layer is formed, the drag coefficient is generally less than the above values, and in case that a turbulent boundary layer is formed, the drag coefficient can be much less than the above. Therefore, the drag coefficient can be reduced to much lower values by forming a plurality of small protrusions or dimples on the surface of the blunt body.

Figure 3:
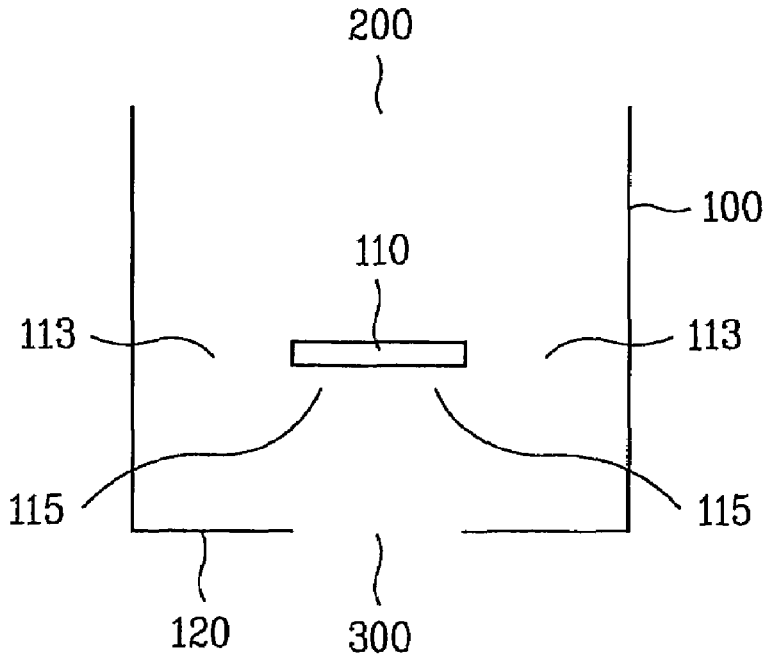
FIGS. 3 and 4 are schematic views of a flow spreading mechanism according to a third and a fourth embodiment of the present invention.

FIG. 3 is schematic view of a flow spreading mechanism according to a third embodiment of the present invention.

Referring to FIG. 3, in the present embodiment, ends 120 of the outlet 300 in the conduit 100 are bent inwardly so that the two flows, which pass by the both sides of the blunt body 110, change their directions and collide with each other right before being discharged through the outlet 300. The present invention uses a plate as a blunt body, but any shape can be employed for the blunt body as mentioned in the second embodiment. In addition, in the present embodiment, the ends 120 of the conduit 100 are constructed to make the two flows having passed by the both sides of the blunt body 113 proceed facing each other in one straight line and then, collide with each other, but it is possible to make the ends 120 of the conduit 100 such that the two flows collide with each other at a predetermined angle other than 180 degrees.

According to the present embodiment, the swing of the discharged flow can be increased by making the two flows, which pass by the both sides 113 of the blunt body 110 and form vortices at the both back sides 115 of the blunt body 110, collide with each other, thus forming stronger vortices.

Figure 4:
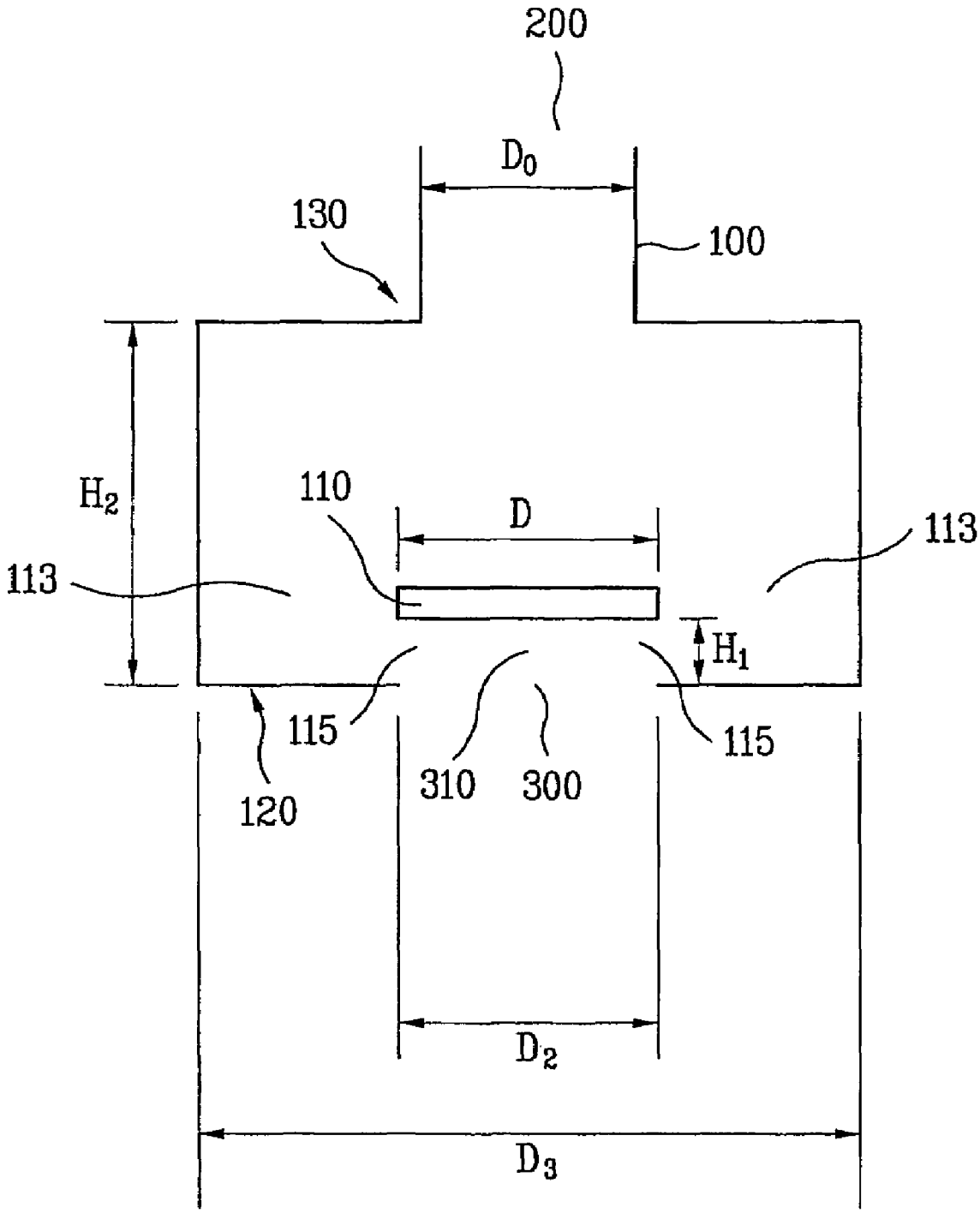

FIG. 4 is a schematic view of a flow spreading mechanism according to a fourth embodiment of the present invention, which is an improvement of the third embodiment.

Referring to FIG. 4, a flow spreading mechanism is constructed such that the flow path right before the outlet 300 is narrower than the flow path bypassing the both sides 113 of the blunt body 110 by placing the blunt body 110 in the embodiment of FIG. 3 closer to the outlet 300. In the embodiment as shown in FIG. 4, the conduit 100 connected with the inlet 200 is configured such that it becomes greater in width from a position right before the position where the blunt body 110 is placed, to form a neck 130, but it may be configured to have a constant width as shown in FIG. 3.

According to the present embodiment, the flow path from the both sides 113 of the blunt body 110 to the position right before the outlet 300 functions as a kind of nozzles, thereby accelerating each flow flowing through the separated flow paths and forming two jets. The two jets collide with each other in a straight line or at a predetermined angle, as in the third embodiment, to increase the static pressure of the flow in the portion 310 right before the outlet 300 above atmospheric pressure and form unsteady-state flow. Combined with the vortices formed by separation, this forms two even stronger vortices at the both back sides 115 of the blunt body 110. The two vortices are varied in size and intensity at a frequency determined by the speed of the introduced flow and the thickness of the plate, and thus the static pressure is varied. As a result, a flow which swings right-and-left while proceeding at a constant frequency is discharged through the outlet 300.

The spreading width of the flow at a location away from the outlet 300 as far as 3.5 times the width of the outlet along the movement direction of the discharged flow, i.e., the width in which the flow has a speed above the steady-state speed of the discharged flow was measured, and the result was that the width was increased by 30-60% compared with the case of using the simple-ducted outlet. In addition, it turned out that increase in Reynolds No. increases the spreading width of the flow, with the rate of increase lowering above a certain Reynolds No. (about 1,400).

Meanwhile, in order to optimize the results, the width $D_0$ of the conduit 100 before the neck 130, the width D of the plate 110, and the width $D_2$ of the outlet 300 are preferably made to be all the same, and also the length $H_2$ of the conduit 100 after the neck 130 and the width $D_3$ of the conduit 100 after the neck 130 are made 1 to 1.5 times and 2 to 2.5 times greater than the width $D_0$ of the conduit 100 before the neck 130, respectively. In addition, the length $H_1$ between the plate 110 and the outlet 300 is preferably made about 0.5 times greater than the width $D_0$ of the conduit 100 before the neck 130.

The flow, which is discharged from the outlet of the flow spreading mechanism in the above first to fourth embodiments and swings while proceeding, spreads over a wider area than in the case of the conventional simple-ducted outlet, but cannot spread in the overall space in case that the space in which the flow spreading mechanism is installed is much larger compared with the swing of the flow. An additional structure is necessary to spread the flow beyond the swing width or area, so the heat is transferred throughout the entire space.

The flow spreading mechanism schematically illustrated in FIG. 7 according to the fifth embodiment of the present invention is constructed to improve the diffusion of the discharged flow by adding another element to the construction of the first to the fourth embodiment.

Figure 5:
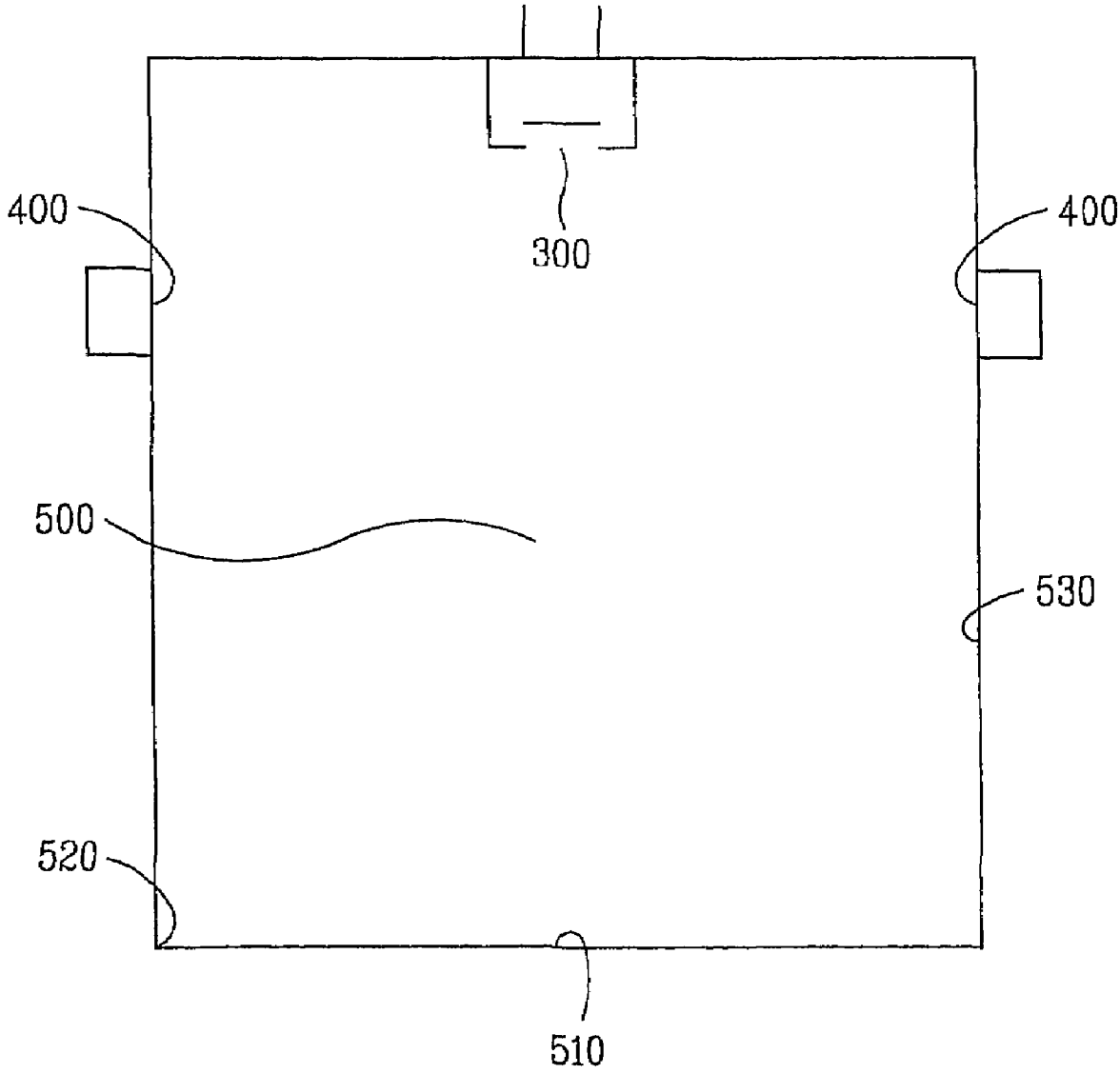
FIG. 5 is a schematic view of a flow spreading mechanism according to a fifth embodiment of the present invention.

Referring to FIG. 5, two sinks 400 are further installed in a space 500 in which the flow spreading mechanism of the first to the fourth embodiment of the present invention is installed, and two sinks are provided to face each other in a line traverse to the moving direction of the flow discharged through the outlet 300, and the two sinks 400 include openings. More than one outlets 300 can be installed, and/or one or more than two sinks 400 can be installed for better uniformity of the flow diffusion and the resulting heat transfer inside the space 500. In case that the outlet 300 is installed in the middle of one wall of the space 500, it is preferable, for uniform heat transfer, to install a pair of sinks 400 to face each other in a line traverse to the moving direction of the flow discharged through the outlet 300, as shown in FIG. 5.

The operation of the embodiment is illustrated below referring to FIG. 5. The flow discharged from outlet 300 substantially goes straight with swing right-and-left, hits the wall 510 of the other side, moves along the wall, hits against the wall corner 520, and moves along the wall 530 in the direction opposite the discharged direction. Without the sinks 400, the flow cannot spread fully across the space and will disappear halfway because of the loss of energy due to two times of hitting of the flow against the walls and because of the resistance against the air pressure inside the space. However, with the existence of the sinks 400, the air inside the space is dispelled out through the sinks 400 50 that the resistance of the flow against the air becomes weaker, and the flow even if it hits the walls two times, can move to the sinks 400, and can be discharged through the sinks 400. Therefore, efficient heat transfer can be uniformly performed all the way across the space.

In the combination structure of the flow spreading mechanism as shown in FIG. 4 and the sinks, the width of the opening of the sinks is preferably made the same as the width D of the plate 110 of FIG. 4 to achieve the optimized effect.

INDUSTRIAL APPLICABILITY

According to the flow spreading mechanism of the present invention, the flow discharged through the outlet swings up-and-down or right-and-left while proceeding so that the diffusion of the flow is enhanced, and the heat can be transferred over a much wider space than in the case of employing the simple-ducted outlet. Therefore, a more uniform temperature distribution can be achieved by discharging a cold or warm air flow using the flow spreading mechanism. In the meantime, according to the flow spreading mechanism including a sink (s) having an opening, the flow can be more uniformly diffused even to the portion where the heat transfer due to the flow is hardly made even by the flow with swing, so as to improve the temperature uniformity. Therefore, problems of a partial freezing or little effect of refrigerating reservation due to the non-uniform supply of coldness in a refrigerator can be solved. Also, in case of an air conditioner or an air conditioning system installed indoors, a uniform supply of coldness or warmth can be achieved so as to provide a more pleasant environment condition.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A flow spreading mechanism comprising:

at least one inlet through which a fluid flow is introduced, the at least one inlet formed in a conduit;

a flow separating means for separating the fluid flow introduced through the at least one inlet into at least two fluid flows; and an outlet for discharging at least two of the at least two fluid flows divided by the flow separating means and joined together at a joining point thereafter, the outlet being formed in the conduit to form a flow path between the inlet and the outlet, wherein the outlet is located adjacent to the joining point where the at least two fluid flows are joined together such that the fluid flow being discharged through the outlet swings while proceeding due to complex vortices caused by the at least two fluid flows being joined together at the joining point and so the fluid flow being discharged through the outlet is discharged to a space outside of the conduit, wherein the conduit is installed in the space, wherein the flow spreading mechanism further comprises at least one sink installed at a predetermined location inside a wall surrounding the space, the at least one sink comprising an opening for discharging fluid inside the space to the outside, wherein air discharged from the outlet moves along the wall, and is dispelled out through the at least one sink;

wherein the flow separating means further comprises a blunt body placed inside the conduit to form two separated flow paths inside the conduit, and wherein the at least one sink has a same width as a width of the blunt body.

2. The flow spreading mechanism of claim 1, wherein the two separated flow paths are formed extending in a part of the conduit.

3. The flow spreading mechanism of claim 2, wherein the blunt body is a plate which is substantially perpendicular to a direction of the flow path inside the conduit.

4. The flow spreading mechanism of claim 2, wherein the blunt body is columnar with its longitudinal axis substantially perpendicular to a direction of the flow path inside the conduit.

5. The flow spreading mechanism of claim 2, wherein ends of the conduit on a side of the outlet are symmetrically bent toward a center of the conduit so that a width of the outlet is smaller than a width of the conduit.

6. The flow spreading mechanism of claim 5, wherein the blunt body is a plate which is substantially perpendicular to a direction of the flow path inside the conduit, and a width of which is uniform.

7. The flow spreading mechanism of claim 6, wherein the plate and the outlet have the same width, and the inlet has the same width as the width of the plate and the outlet.

8. The flow spreading mechanism of claim 7, wherein a length of a portion of the conduit having a different width from the width of the inlet is 1 to 1.5 times the width of the inlet, and the width of the portion is 2 to 2.5 times the width of the inlet.

9. The flow spreading mechanism of claim 8, wherein an interval between the plate and the outlet is about 0.5 times the width of the outlet.

10. A flow spreading mechanism comprising:

at least one inlet through which a fluid flow is introduced;

a flow separating means for separating the fluid flow introduced through the at least one inlet into at least two fluid flows; and an outlet for discharging at least two of the at least two fluid flows to an outside of the flow spreading mechanism, the at least two fluid flows being divided by the flow separating means and joined together thereafter, wherein complex vortices are formed adjacent to the outlet and thus, the fluid flow being discharged through the outlet swings while proceeding and so the fluid flow being discharged through the outlet is discharged to a wider space than a width of the outlet, wherein the flow separating means comprises:

a conduit to form a flow path between the inlet and the outlet, and installed in the space; and a blunt body placed inside the conduit to form two separated flow paths inside the conduit, at least one sink installed at a predetermined location inside a wall surrounding the space and having a same width as the width of the blunt body, the at least one sink comprising an opening for discharging fluid inside the space to the outside, wherein air discharged from the outlet moves along the wall, and is dispelled out through the at least one sink;

wherein the two separated flow paths are formed extending in a part of the conduit and are formed adjacent to the outlet in the conduit, wherein ends of the conduit on a side of the outlet are symmetrically bent toward a center of the conduit so that a width of the outlet is smaller than a width of the conduit, wherein the blunt body is a plate which is substantially perpendicular to the direction of the flow inside the conduit, and the width of which is uniform, and wherein an interval between the plate and the outlet is set smaller than the width of the outlet such that the flow path from both sides of the plate to the outlet functions as nozzles.

11. The flow spreading mechanism of claim 10, wherein a number of the at least one sink is even-numbered, and each pair of the sinks are installed to face each other in a line traverse to a movement direction of the flow discharged through the outlet.

12. A flow spreading mechanism comprising:

at least one inlet through which a fluid flow is introduced;

a flow separating means for separating the fluid flow introduced through the at least one inlet into at least two fluid flows; and an outlet for discharging at least two of the at least two fluid flows, which are divided by the flow separating means and joined together thereafter, wherein complex vortices are formed adjacent to the outlet and thus, the fluid flow being discharged through the outlet swings while proceeding, wherein the flow separating means comprises:

a conduit to form a flow path between the inlet and the outlet; and a blunt body placed inside the conduit to form two separated flow paths inside the conduit, wherein the two separated flow paths are formed extending in a part of the conduit, wherein the two separated flow paths are formed adjacent to the outlet in the conduit, wherein ends of the conduit on a side of the outlet are symmetrically bent toward a center of the conduit so that a width of the outlet is smaller than a width of the conduit, wherein the blunt body is a plate which is substantially perpendicular to a direction of the flow path inside the conduit, and a width of which is uniform, wherein the plate and the outlet have the same width, and the inlet has the same width as the width of the plate and the outlet, wherein the outlet is installed in a space, and wherein the flow spreading mechanism further comprises at least one sink installed at a predetermined location inside the space, the sink including an opening for discharging fluid inside the space to the outside and having a same width as the width of the plate.

13. A flow spreading mechanism comprising:

a conduit having an inlet and an outlet, the conduit being installed in a space; and a blunt body placed inside the conduit and configured to break an inlet fluid flow coming from the inlet into at least two separate fluid flows and then join the at least two separate fluid flows at a joining point thereafter into a discharge fluid flow discharged through the outlet, at least one sink installed at a predetermined location inside a wall surrounding the space and having a same width as the width of the blunt body, the at least one sink comprising an opening for discharging fluid inside the space to the outside, wherein air discharged from the outlet moves along the wall, and is dispelled out through the at least one sink, wherein the outlet of the conduit is located adjacent to the joining point where the at least two fluid flows are joined together such that the discharged fluid flow being discharged through the outlet swings while proceeding due to complex vortices caused by the at least two fluid flows being joined together at the joining point, wherein ends of the conduit on a side of the outlet are symmetrically bent toward a center of the conduit so that a width of the outlet is smaller than a width of the conduit, wherein a width of the outlet is less than a width of the blunt body, wherein a width of the inlet is less than a width of the conduit such that an inlet neck portion is formed, and wherein a width of the inlet neck portion is less than a width of the blunt body and a width of the outlet.

14. The flow spreading mechanism of claim 13, wherein the blunt body comprises at least one from:

a plate installed substantially perpendicular to a direction of the inlet fluid flow inside the conduit, a rectangular-shaped body, a diamond-shaped body, a triangular-shaped body, a semi-circle-shaped body, a circle-shaped body, and an oval-shaped body.

15. The flow spreading mechanism of claim 14, wherein a distance between the blunt body and the outlet is smaller than a width of the outlet.

* * * * *